United States Patent [19]

Breckel

[11] 4,255,778

[45] Mar. 10, 1981

[54] REFERENCE SIGNAL PROCESSOR CIRCUIT

[75] Inventor: Werner Breckel, Wendlingen, Fed. Rep. of Germany

[73] Assignee: Robert Bosch GmbH, Stuttgart, Fed. Rep. of Germany

[21] Appl. No.: 48,038

[22] Filed: Jun. 13, 1979

[30] Foreign Application Priority Data

Jun. 24, 1978 [DE] Fed. Rep. of Germany ..... 2827799

[51] Int. Cl.[3] ..... F02P 17/00

[52] U.S. Cl. ..... 361/236; 324/392

[58] Field of Search ..... 361/236, 239, 240; 324/169, 170, 391, 392; 73/116, 117.2, 117.3

[56] References Cited

U.S. PATENT DOCUMENTS 4,039,931 8/1977 Schweizer ..... 324/392

FOREIGN PATENT DOCUMENTS 2552420 5/1977 Fed. Rep. of Germany ..... 324/391

2802019 1/1978 Fed. Rep. of Germany ..... 324/391

*Primary Examiner*—Harry E. Moose, Jr.

*Attorney, Agent, or Firm*—Frishauf, Holtz, Goodman & Woodward

[57] ABSTRACT

To counteract the phase error in the signal from an rpm transducer of an engine test stand or analyzer at varying engine speeds, the signal processor of the invention receives the transducer signal whose amplitude varies with frequency and generates therefrom an output signal of constant amplitude. This signal is supplied to a threshold switch which includes circuitry for integrating periodic output signals and generating therefrom a control signal whose amplitude is proportional to the frequency of the input signal. This analog signal is used to alter the switching threshold of the threshold switch, thereby imparting to the output signal a frequency compensation which counteracts the inherent phase error and results in an output signal of constant phase with respect to the transducer signal. The apparatus of the invention is particularly useful for adjusting ignition timing, valve timing, etc. in internal combustion engines in which the input signal is derived from the crankshaft speed.

9 Claims, 4 Drawing Figures

REFERENCE SIGNAL PROCESSOR CIRCUIT

FIELD OF THE INVENTION

The invention relates generally to signal generators and more particularly to the phase correction of signals from inductive generators. Still more particularly, the invention relates to inductive signal generators used in testing apparatus for internal combustion engines to determine the relative timing of ignition, fuel injection, etc. with respect to the occurrence of a given crankshaft angle, for example the top dead center position (TDC).

BACKGROUND AND STATE-OF-THE ART

The timing and adjustment of internal combustion engines, especially on test stands, requires an exact measurement of, for example, the ignition angle relative to the occurrence of crankshaft positions and particularly the top dead center position (TDC). It is found experimentally that the indicated angular displacement of the TDC with respect to other events is subject to a systematic variation, in particular as a function of the engine speed. In other words, the measured interval between a signal generated at the occurrence of TDC and another signal generated at the time of occurrence of ignition is not exactly equal to the time elapsing between the corresponding crankshaft angles and, furthermore, this inexactness increases with increasing engine speed in a monotonic fashion.

In known engine test stands, a provision has been made to diminish this error by installing a function generator which generates a voltage curve that is the mirror image of the error curve and is used for its compensation. Such equipment is described for example in the German Disclosure Document No. 25 52 420. However, the provision of a separate function generator and the associated processing circuitry adds expense to the construction and opportunity for malfunction.

THE INVENTION

It is thus a principal object of the present invention to provide an apparatus which receives an inductively generated TDC signal and which provides a correction as a function of engine speed so as to provide a reference crankshaft signal that is compensated for phase errors resulting from varying engine speed.

An associated object of the invention is to provide a signal generator which substantially improves the precision of measurement in engine timing. Still another object of the invention is to provide phase compensaton even when the engine speed varies rapidly, particularly when it decreases rapidly. The apparatus of the invention is also relatively immune to external noise because the apparatus performs noise amplitude discrimination and effectively suppresses spurious signals. Still another advantage of the invention over the prior art is that the minimum engine speed at which a correction can be effected is substantially lower than in the prior art. The apparatus of the invention also provides a digital and an analog output signal which may be used to feed an associated analog or digital tachometer. These and other objects are attained according to the invention by providing a control amplifier which receives the crankshaft signal and which generates an output signal of constant amplitude which is applied to a threshold switch whose threshold can be shifted in dependence of engine speed.

The amplification factor of the control amplifier can be altered by changing the magnitude of the feedback resistance of the ampifier. The control current which indirectly changes the resistance of the feedback resistor is supplied by a capacitor which illuminates a light-emitting diode whose emissions impinge on the light-sensitive feedback resistor. In one embodiment of the invention, the control current of the light-emitting diode is proportional to the voltage on the capacitor and the capacitor is recharged by a differential amplifier that is controlled by the output signal of the control amplifier. The low internal resistance of the differential amplifier insures that the charge on the capacitor can be increased very rapidly. In order to insure the rapid discharge of the capacitor during engine deceleration, the preferred embodiment of the invention provides a switchable discharge path which permits periodic rapid discharges of the capacitor during engine speed decreases.

The differential amplifier receives a reference voltage whose amplitude is such that spurious pulses are prevented from being recognized by the threshold switch. The threshold of the differential amplifier is further changed as a function of engine speed on the basis of the frequency of occurrence of the output pulses from the threshold switch.

Detailed features and advantages of the invention will become evident from the following description of a preferred exemplary embodiment which is related to the illustrations of the drawing.

THE DRAWING

FIG. 1 is a block circuit diagram of an engine test stand including an inductive crankshaft transducer and signal processing circuitry;

FIG. 2*a* is a diagram of the transducer output signal at low engine speed;

FIG. 2*b* is a diagram of the transducer output signal at high engine speed;

FIG. 3*a* is another representation of the transducer output signal and FIG. 3*a* is a timing diagram illustrating the occurrence of various signals at different points of the circuit of the invention;

FIG. 4 is a detailed circuit diagram of an exemplary embodiment of the invention.

DESCRIPTION OF THE PREFERRED EMBODIMENT

Figure 1:
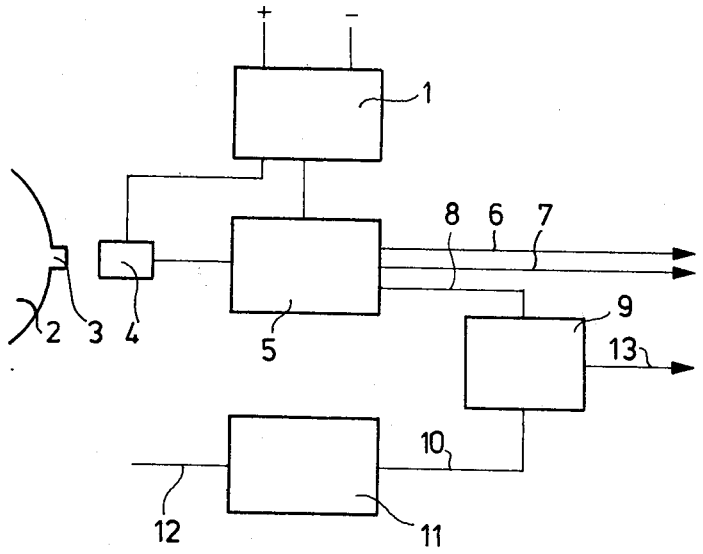
Figure 2A:
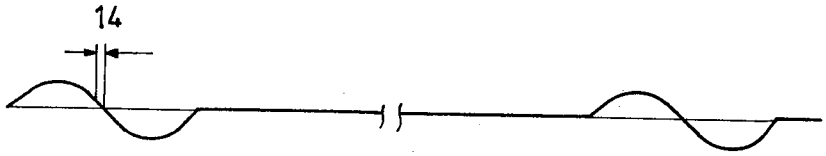
Figure 2B:
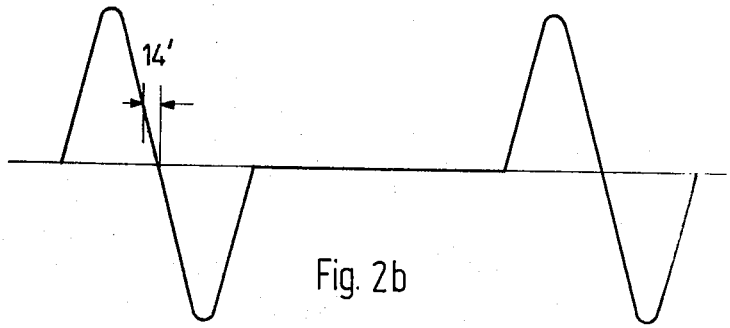

An engine test stand analyzer is illustrated schematically and generally by the block diagram of FIG. 1. Such engine analyzers serve to adjust various controls in an internal combustion engine, in particular the injection timing, the valve opening and closing times, the ignition timing, etc. The most frequently performed adjustment is the adjustment of the ignition timing, i.e., the adjustment of the spatial angle between the occurrence of top dead center (TDC) of the crankshaft and the point of ignition in the first cylinder of the engine. In order to perform this timing, the apparatus includes a preferably inductive transducer which generates a reference signal when the crankshaft is at TDC. This signal can serve as a reference only if its recognized occurrence remains constant with respect to the actual physical angle of rotation of the crankshaft. Typically, an engine analyzer of this type includes a power supply 1 for supplying power to various other parts of the apparatus. The crankshaft transducer may be a disc 2 mounted on the crankshaft of an engine, not shown, in rigid manner. At one part of its periphery, the disc 2 has a pin 3 which passes a sensor 4 in which it induces a pulse whose time behavior is approximately sinusoidal and whose amplitude is a strong function of engine speed which itself may vary by a factor of approximately 70 (between 100 rpm and 7,000 rpm). Accordingly, the dynamic range of the transducer signal is large and must be accommodated by the subsequent processor circuit 5. The circuit 5 has two or three output signal contacts, an output contact 6 which carries an analog engine speed signal, an output 7 for driving a digital tachometer or engine speed indicator and an output 8 which carries a signal that has a constant phase relationship to the top dead center position of the crankshaft. This latter signal occurring on the output contact 8 is fed to a bistable multivibrator 9, the other triggering input of which receives a trigger signal from a trigger pulse generator 11 via a line 10. The trigger pulse generator 11 is controlled by a signal related to the onset of ignition and is received on a line 12. The duration of the output pulse at the output 13 of the bistable multivibrator 9 is thus directly proportional to the ignition angle, i.e., the relative temporal separation between the signal occurring on the line 12 and the passage of the center of the pin 3 across the transducer 4.

Figure 4:
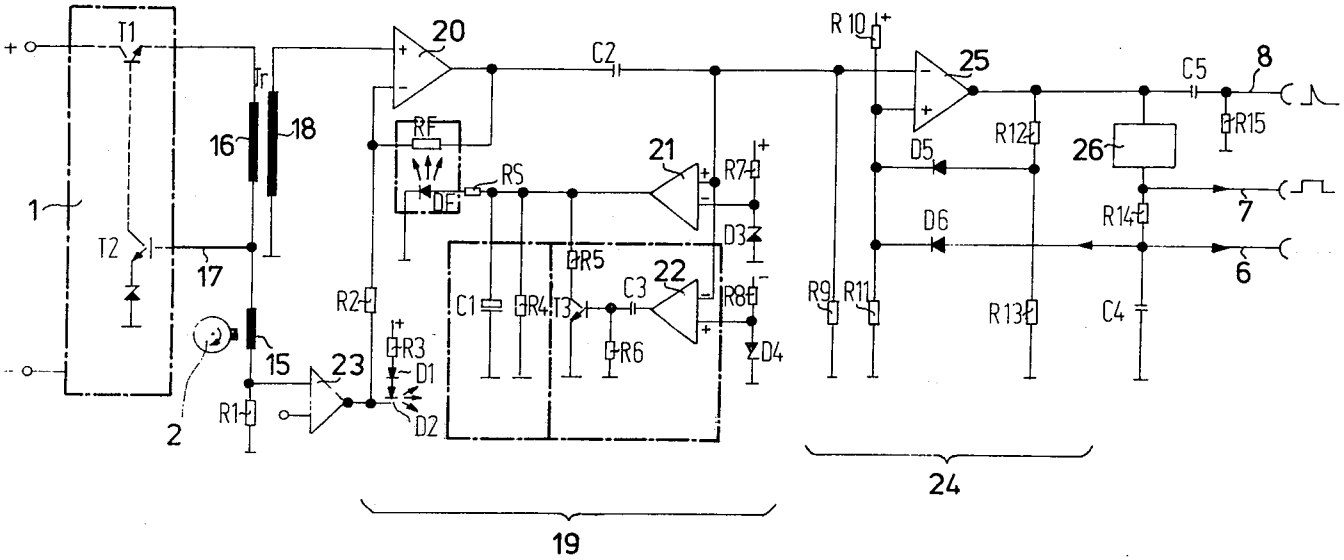

FIGS. *2a* and *2b* illustrate the pulses occurring at the output of the transducer 4. FIG. *2a* represents pulses at low engine speed and FIG. *2b* represents pulses at high engine speed. The relative illustrated amplitudes are not to scale and it should be recognized that the ratio of amplitudes is substantially greater than shown, i.e., the high speed pulse has an amplitude many times greater than the low speed pulse. Of principal significance to the present invention furthermore is the fact that the zero crossing of the transducer pulse, whose overall extent may be, for example, 6° of crankshaft angle, is not coincident with the occurrence of the actual top dead center. At low engine speed, the phase angle 14 may be for example 0.2° whereas at elevated engine speed, the phase error 14' in FIG. *2b* may amount to a full degree of crankshaft angle. The overall pulse length, i.e., 6° in the present example, remains substantially constant because it depends only on the geometry of the transducer assembly, i.e., the pin 3, the sensor 4 and their relative separation. It is a principal object of the present invention to automatically compensate for the varying phase error 14 or 14' so as to make the output signal on line 8 independent of engine speed and of constant phase with respect to TDC. The invention may be practiced in a preferred exemplary way by an apparatus whose circuitry is illustrated in FIG. 4.

The sensor 4 of the inductive transducer assembly includes a coil 15 which is supplied with power by the power supply 1 and is connected through a measuring resistor R1 to ground or the negative bus of the circuit. The other side of the coil 15 is connected to the primary windings 16 of a transformer Tr whose other side is also connected to the power supply 1. The power supply may deliver a constant current, or the series connection of the coil 15 and the resistor R1 may receive a constant voltage on a line 17. The pulses generated by the coil 15 are transmitted to the secondary windings 18 of the transformer Tr, one side of which is grounded and the other side of which is connected to the non-inverting input of a control amplifier assembly 19. The control amplifier assembly 19 has an operational amplifier 20 whose inverting input is connected to its own output via a feedback resistor RF. In the illustrated embodiment, the feedback resistor RF is a light-sensitive resistor which is part of a unit that also contains a light-emitting diode DF. Depending on the degree of luminance of the diode DF, the resistance of the feedback resistor RF is changed. The output of the operational amplifier 20 is connected via a capacitor C2 to the non-inverting input of a differential amplifier 21 as well as to the inverting input of differential amplifier 22. A resistor R7 and a zener diode D3 are connected in series to supply a reference voltage to the inverting input of the differential amplifier 21. Similarly, a resistor R8 and a zener diode D4 are connected in series to supply a constant reference voltage to the non-inverting input of the differential amplifier 22. A capacitor Cl and a resistor R4 are connected in parallel to the output of the differential amplifier 21 and are grounded at their other end. A protective resistance RS is connected between the output of the differential amplifier 21 and the light-emitting diode DF whose cathode is grounded.

The base of an NPN transistor T3 is connected via a coupling capacitor C3 to the output of the differential amplifier 22. The emitter of the transistor T3 is grounded and its collector is connected via a load resistor R5 to the output of the differential amlifier 21. A base resistor R6 connects the base of the transistor T3 to ground.

The junction of the coil 15 and the resistor R1 is connected to one input of a differential amplifier 23 whose other input receives a fixed reference voltage. The output of the differential amplifier 23 is connected through a resistor R2 to the same input of the operational amplifier 20 that is connected to the feedback resistor RF. A light-emitting diode D2 is connected through a resistor R3 and the diode D1 to the output of the differential amplifier 23 to indicate when the coil 15 carries current. If the diode D2 is not illuminated, the primary circuit of the transformer Tr may be assumed to be open. If this is the case, the resistor R2 causes the operational amplifier 20 to assume an amplification factor of approximately unity.

The voltage pulse which is delivered by the secondary windings 18 to the operational amplifier 20 is amplified to a constant value which is independent of the amplitude of the input pulse. This purpose is achieved by connecting the operational amplifier 20 as part of a control amplifier assembly 19, which functions as follows. If the output voltage of the operational amplifier 20 reaches the level of the reference voltage fed to the inverting input of the differential amplifier 21, the capacitor C1 is charged. As the capacitor voltage increases, the current through the light-emitting diode DF also increases and causes increased illumination of the resistor RF which increases the degree of feedback and reduces the amplification factor of the amplifier. If the output voltage does not reach the level of the reference voltage applied to the inverting input of the amplifier 21, the capacitor C1 is able to discharge slowly through the resistor R4 and the light-emitting diode DF. As the capacitor voltage decreases and the current through the light-emitting diode DF also decreases, the decreasing light emission causes an increase of the resistance of the resistor RF which increases the gain of the amplifier 20 until the output voltage of the differential amplifier 21 becomes equal to the reference voltage. In this manner, the control amplifier maintains a constant amplitude of the output signal in a required dynamic domain of approximately 55 dB.

The basic closed loop connection of the upper part 20 as described so far is sufficient to maintain constant output amplitude except when the engine speed decreases rapidly. In that case, the discharge of the capacitor C1 through the resistor R4 is too slow to permit the voltage on the capacitor C1 to follow the decrease of engine speed. In order to obtain a sufficiently rapid response when the engine speed drops, the control amplifier 19 includes the differential amplifier 22 whose reference voltage is approximately one-half of the negative excursion of the signals from the operational amplifier 20. As soon as this voltage is reached, the differential amplifier 22 responds and sends a short pulse through the elements C3 and R6 to the base of the transistor T3 causing the latter to conduct for a short time, approximately 10–25 microseconds. This time suffices to discharge the capacitor C1 through the transistor T3 and the load resistor R5 by approximately 10% which suffices to respond to even rapid decreases of engine speed.

The output signal of the control amplifier 19 is thus of constant amplitude, independent of engine speed. Any spurious pulses which occur between the useful pulses are also amplified but they do not alter the amplification factor (gain) because of their lower amplitude, normally far below 50% of the amplitude of the useful signal.

Connected to the output of the operational amplifier 20, i.e., at the capacitor C2, is a threshold switch assembly 24 which performs the phase compensation as well as the suppression of spurious pulses in conjunction with the control amplifier 19. The threshold switch 24 includes a comparator or differential amplifier 25 whose inverting input receives the output of the control amplifier 19. The output capacitor C2 is also connected to a discharging resistor R9 whose other side is connected to ground. A voltage divider R10, R11 connected between the operational voltage and ground delivers a voltage of approximately 0.1 V to the non-inverting input of the differential amplifier 25. The output of the differential amplifier 25 feeds a further voltage divider R12, R13 whose tap is connected to a diode D5 to supply a biasing voltage to the non-inverting input of the differential amplifier 25. The voltage drop across the resistor R11 is chosen to be approximately 75% of the positive peak value of the output voltage of the control amplifier 19. Accordingly, the differential amplifier 25 will not respond to spurious signals whose amplitude is less than 75% of the amplitudes of the useful signal, so that spurious signals amplified by the control amplifier 19 are suppressed by the threshold switch 24. Further connected to the output of the differential amplifier 25 is a monostable multivibrator 26 which serves as a pulse generator whose output produces a rectangular signal of constant amplitude and constant duration at the occurrence of each and every input pulse. This output signal is integrated by an integrating assembly consisting of the resistor R14 and a capacitor C4, the voltage across which is proportional to the number of pulses per unit time. The output 6 is connected to the capacitor C4 and carries an analog signal proportional to engine speed. The capacitor C4 is also connected through a diode D6 to the non-inverting input of the differential amplifier 25 so that an rpm-dependent biasing voltage is applied to the differential amplifier 25 and causes a shift in the time of response of the differential amplifier 25 with respect to the decreasing edge of the pulse received from the control amplifier 19. When the engine speed is low and the voltage on the capacitor C4 is small, this shift is small but increases with increasing engine speed.

Figure 3:
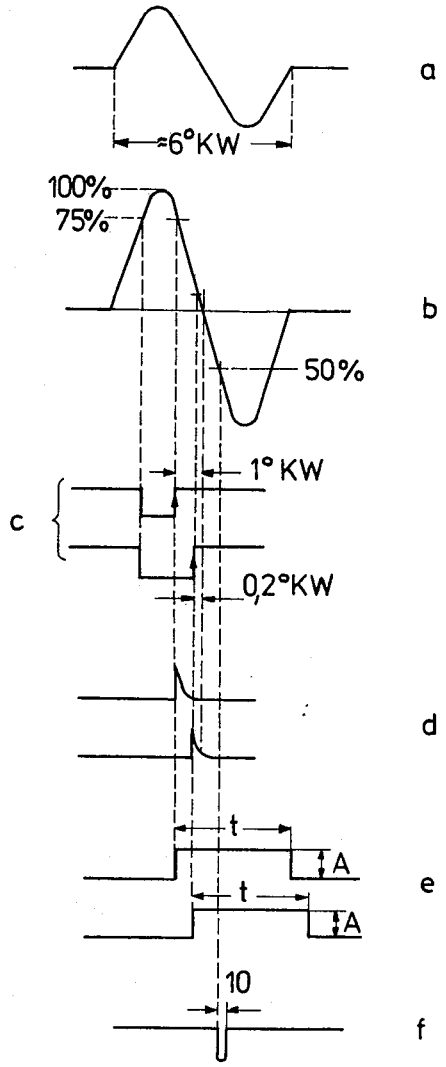

The output of the monostable multivibrator 26 which is triggered by the positive-going edges of each of the output pulses from the differential amplifier 25 constitutes the output 7 for driving a digital tachometer. The output of the differential amplifier 25 is coupled through a differentiating connection C5, R15 to the output 8 upon which appear spikes whose positive-going edges constitute the occurrence of the top dead center and whose phase relationship to the physical occurrence of top dead center is substantially constant as will be explained in relation to FIG. 3.

FIG. 3*a* again illustrates the transducer signal, i.e., the signal present at the output of the transformer Tr whose amplitude may vary in a range of approximately 60 dB according to the prevailing engine speed and whose duration is approximately equal to 6° of crankshaft angle. Accordingly, the duty cycle is approximately 1/60. Fig. 3*b* is a diagram illustrating the signal occurring at the output of the control amplifier 19 whose amplitude is constant but otherwise corresponds to the signal of FIG. 3*a*. FIG. 3*c* shows the output pulse from the differential amplifier 25 within the threshold switch 24. This switch is activated when the signl in 3*b* reaches 75% of its nominal positive amplitude. The pulse illustrated in the top part of FIG. 3*c* corresponds to a high engine speed while the lower pulse in FIG. 3*c* corresponds to a low engine speed. The trailing edges of these two pulses do not coincide because the transducer 4 exhibits an rpm-dependent phase shift with respect to the occurrence of TDC. When the signals of FIG. 3*c* are differentiated by the elements C5, R15, one obtains the signals illustrated in FIG. 3*d* which constitute the output signals of the circuit and are in a fixed phase relationship with respect to top dead center. FIG. 3*e* illustrates the output signal of the monostable multivibrator 26 which generates a pulse of constant duration and amplitude independently of engine speed although the occurrence of the pulse is shifted in phase by the prevailing engine speed because the positive-going edge of the pulses in FIG. 3*c* is coincident with the positive-going edge of the pulses according to FIG. 3*e*. FIG. 3*f* illustrates the pulse occurring at the output of the differential amplifier 22 which is generated when the signal reaches 50% of the negative excursion of the pulse of FIG. 3*b* and whose duration is fixed by the associated components.

The foregoing description refers to a preferred exemplary embodiment of the invention. Within the scope and spirit of the invention, other embodiments and variants thereof are possible.

I claim:

1. A signal processor comprising:

a variable gain control amplifier (19) for receiving and processing a periodic signal of varying amplitude and for generating therefrom an output signal of constant amplitude; and a threshold switch (24) connected to said control amplifier to receive said output signal and including circuit means for varying the switching threshold of said threshold switch (24) in dependence of the frequency of said periodic signal.

2. A signal processor according to claim 1, wherein said control amplifier includes an operational amplifier (20) having a feedback resistor whose resistance may be varied in dependence of a control current; whereby the gain of said control amplifier is variable.

3. A signal processor according to claim 2, wherein said control amplifier includes a capacitor (C1) for supplying said control current, and wherein there is provided a differential amplifier (21) for supplying control current to said capacitor (C1), the one input of said differential amplifier (21) being connected to the output of said operational amplifier (20), and the other input of said differential amplifier (21) being connected to a source of fixed voltage (R7, D3).

4. A signal proccessor according to claim 3, further comprising a controllable switch (T3) connected to said capacitor (C1), for selective discharge of a predetermined quantity of charge from said capacitor (C1) at the occurrence of output signals from said control amplifier (19) of sufficient amplitude.

5. A signal processor according to claim 1, wherein said threshold switch (24) includes a differential amplifier (25) one input of which is connected to the output of said variable gain control amplifier (19) and the other input of which is connected to a source of biasing voltage whose magnitude is greater than the average level of spurious signals.

6. A signal processor according to claim 5, wherein said source of biasing voltage for said differential amplifier (25) includes a voltage divider (R10, R11) connected to a power supply contact of the processor and a further voltage divider (R12, R13) connected to the output of said differential amplifier (25).

7. A signal processor according to claim 6, further comprising a pulse-shaping circuit (26) and an integrating circuit (R14, C4), said integrating circuit serving to produce an analog voltage whose magnitude is proportional to the frequency of said output signal from said control amplifier, the output of said integrator being connected to the input of said differential amplifier (25) which is also connected to said voltage dividers (R10,R11; R12, R13).

8. A signal processor according to claim 7, wherein said pulse shaping circuit is a monostable multivibrator (26) and wherein said integrator includes an RC member (R14,C4).

9. A signal processor according to claim 1, wherein said input signal is generated by a signal transducer including a sensing coil (15), said sensing coil (15) being connected to one input of a differential amplifier (23) whose output is connected to one input of said control amplifier (19) for lowering the gain thereof when no current flows in said coil (15).

* * * * *